US005465517A

United States Patent [19]

Garofalo

[11] Patent Number: 5,465,517

[45] Date of Patent: Nov. 14, 1995

[54] SAFETY CATCH FOR UNDERWATER GUNS

[75] Inventor: Giovanni Garofalo, Rapallo, Italy

[73] Assignee: HTM Sport S.p.A., Italy

[21] Appl. No.: 297,546

[22] Filed: Aug. 31, 1994

[30] Foreign Application Priority Data

Sep. 29, 1993 [IT] Italy ..... GE93A0084

[51] Int. Cl.[6] ..... F41A 17/46

[52] U.S. Cl. ..... 42/70.06; 42/1.14

[58] Field of Search ..... 42/70.06, 70.01, 42/70.04, 1.14

[56] References Cited

U.S. PATENT DOCUMENTS

| | | | |
|---|---|---|---|
| 846,591 | 3/1907 | Mason | 42/70.06 |
| 2,225,583 | 12/1940 | Blizard | 42/70.06 |
| 2,563,720 | 8/1951 | Guisasola | 42/70.06 |
| 2,657,490 | 11/1953 | Browning | 42/70.06 |
| 3,222,809 | 12/1965 | Bryan | 42/70.06 |
| 4,677,781 | 7/1987 | Lee | 42/70.01 |
| 4,897,951 | 2/1990 | Osborne | 42/70.06 |
| 5,341,732 | 8/1994 | Landers | 42/70.06 |

*Primary Examiner*—Charles T. Jordan
*Attorney, Agent, or Firm*—Larson and Taylor

[57] ABSTRACT

A safety catch in particular for underwater guns or the like, comprises movable means for locking the travel of a trigger for activation of means of firing a projectile element. In oder to avoid direct, visual checking of the condition of the safety catch, according to the invention the safety catch is provided with means for indicating the condition of activation thereof, which in the position of locking the travel of the trigger are disposed such that they can be felt directly by the hand or finger which controls activation of the trigger, in the normal position For grasping the grip of the gun and/or the trigger.

12 Claims, 2 Drawing Sheets

SAFETY CATCH FOR UNDERWATER GUNS

BACKGROUND OF THE INVENTION

The invention relates to a safety catch, in particular for underwater guns or the like, comprising moveable means for locking the travel of a trigger for activation of means of firing a projectile element.

In particular, in underwater guns, the conventional safety mechanisms which lock the control travel of the trigger are produced such that activation or de-activation thereof must be checked visually by the user. They are disposed in the area of the trigger and/or the grip of the gun, and thus can only be checked by moving the weapon away from the ready-to-fire or aiming position, and by examining it.

This is a relatively dangerous disadvantage which is a potential source of accidents since, depending on the circumstances, having initially set the weapon with the safety catch activated or deactivated, the user can forget this manoeuvre and mistakenly be convinced that the safety catch is for example activated when it is not, and vice versa. In the first case, obviously it is possible to fire accidentally and in a random direction. In the second case on the other hand, either it is not possible to shoot the spear, or the safety catch is forced and damaged by means of violent action of the trigger, also giving rise to ejection of the spear.

SUMMARY OF THE INVENTION

The object of the invention is to produce a safety catch of the type initially described, in particular for underwater guns, such that the above-described disadvantages can be eliminated by simple, inexpensive and functionally safe means.

The aforementioned object of the invention is achieved by means of a safety catch of the type initially described, which is provided with means for indicating activation thereof, and which in the position of locking the travel of the trigger, are in a position such that they can be felt directly by the hand and/or finger which controls activation of the trigger, in the normal position for grasping the grip and the trigger.

Advantageously, in the position of activating the safety catch, the indicating means are superimposed on the side of the trigger, and in the area of support of the user's control finger.

According to a preferred embodiment, the safety catch is provided with rotary control means, and it is activated and deactivated by means of rotary movement around an axis transverse to the direction of travel of the trigger, whereas the activation indicating means consist of a transverse bar, which is integrally and mechanically connected to the means of controlling the safety catch, such that it can be tilted integrally therewith, or alternatively into a raised position against the body of the gun, in which it does not interfere with the trigger and the finger which controls the latter, when the safety catch is deactivated, and into a position of abutment against the side for grasping the trigger, when the safety catch is activated.

Thus, by means of the invention, when the safety catch is activated, the user can check this condition directly, without any special manoeuvres. In particular in the preferred embodiment, the transverse bar is interposed between the finger which presses on the trigger and the trigger itself, and the presence of the said bar can be detected directly by touch. In addition, this structure permits activation and/or at least de-activation of the safety catch by the same finger which controls the trigger, without having to adjust the correct grip of the gun.

BRIEF DESCRIPTION OF THE DRAWINGS

The specific features of the invention and the resulting advantages will become apparent in greater detail from the description of some preferred embodiments, illustrated by way of non-limiting example in the attached drawings, in which.

DESCRIPTION OF THE PREFERRED EMBODIMENT OF THE INVENTION

Figure 1:
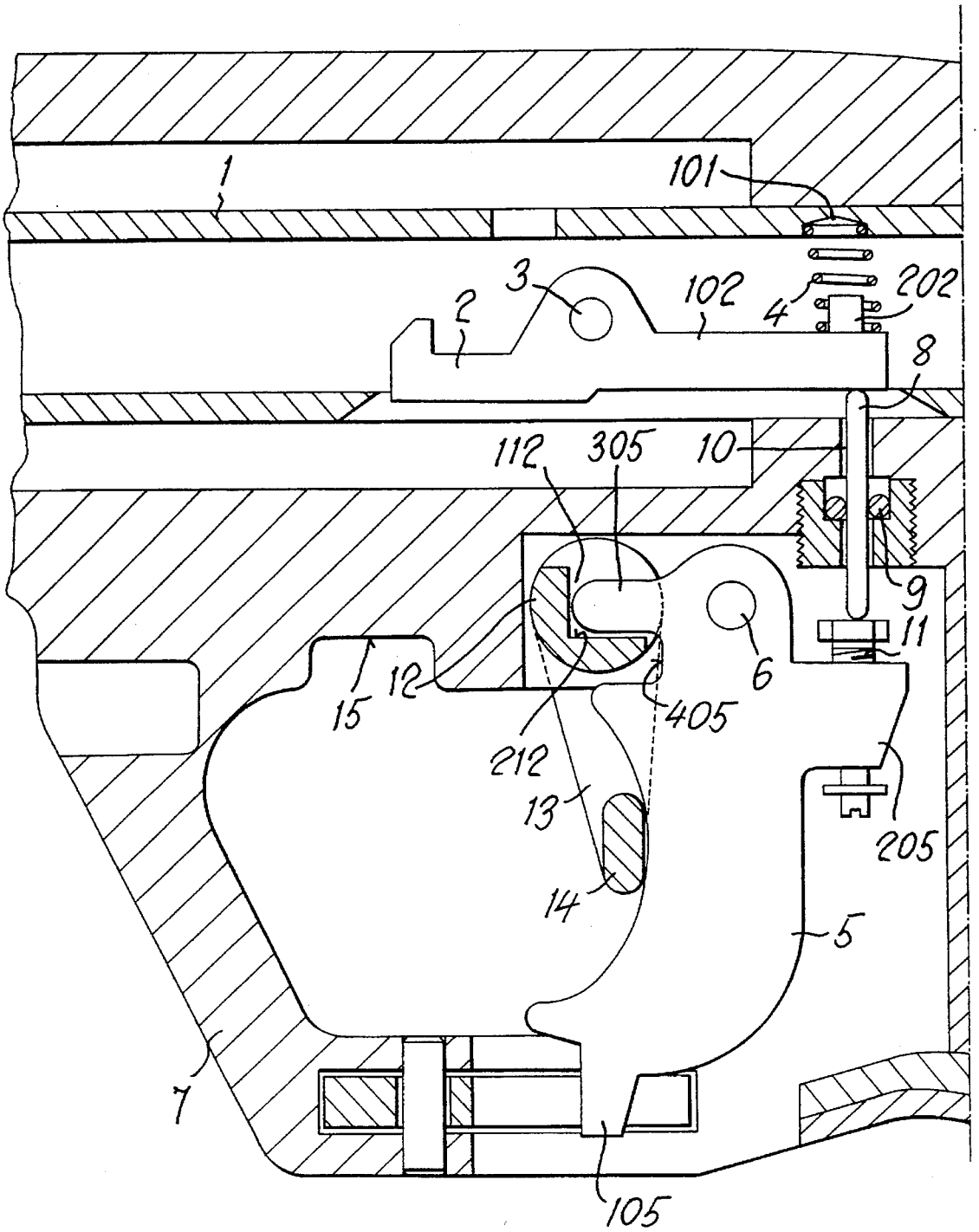
FIG. 1 is an enlarged cros-section detail of the trigger area of an underwater gun according to the invention, with the safety mechanism in the activated position.

An underwater gun according to the figures has a tubular barrel 1 in which a spear (not shown) can be inserted. At the rear end of the barrel 1 there is a hook 2 which is supported such as to oscillate around an axis perpendicular to the axis of the barrel 1, and which is disposed on the lower side thereof. On the side opposite the fulcrum pin 3, the hook 2 has an axial control projection 102. Between the axial control projection 102 and the opposite upper inner side of the barrel 1, there is interposed a helical spring 4 which thrusts the hook 2 upwards into a position of stable engagement is a corresponding engagement notch in the spear. The helical spring is engaged at its ends in a seat 101 which is recessed in the wall of the barrel 1, and on a transverse projection 202 of the control projection 102.

Below the oscillating hook 2 there is supported such as to oscillate around an axis perpendicular to the axis of the barrel 1, a trigger 5 which is hinged at a fulcrum pin 6 with its upper end to the body of the gun. The trigger 5 is inserted in a guard 7 and engages at its base in a guide of the guard 7, which guide faces in the direction of oscillation, by means of an extension piece 105. On the rear side, i.e. on the side opposite that grasped by a finger, and in an intermediate area, the trigger 5 has a transverse rear projection 205. This rear projection 205 is disposed beneath the projection 102 for controlling the hook 2, and is connected thereto by means of a vertical thrust rod 8 which can slide freely in the direction of its length. The thrust rod 8 is guided in a sealed manner by means of a seal 9, through a hole 10 in the body of the gun and an aperture in the barrel 1 for accommodating the hook 2. In order to permit adjustment, the thrust rod 8 is supported against the head of an adjustment screw 11 which is oriented parallel thereto, and is screwed into a complementary threaded hole in the rear projection 205 of the trigger 5.

Figure 2:
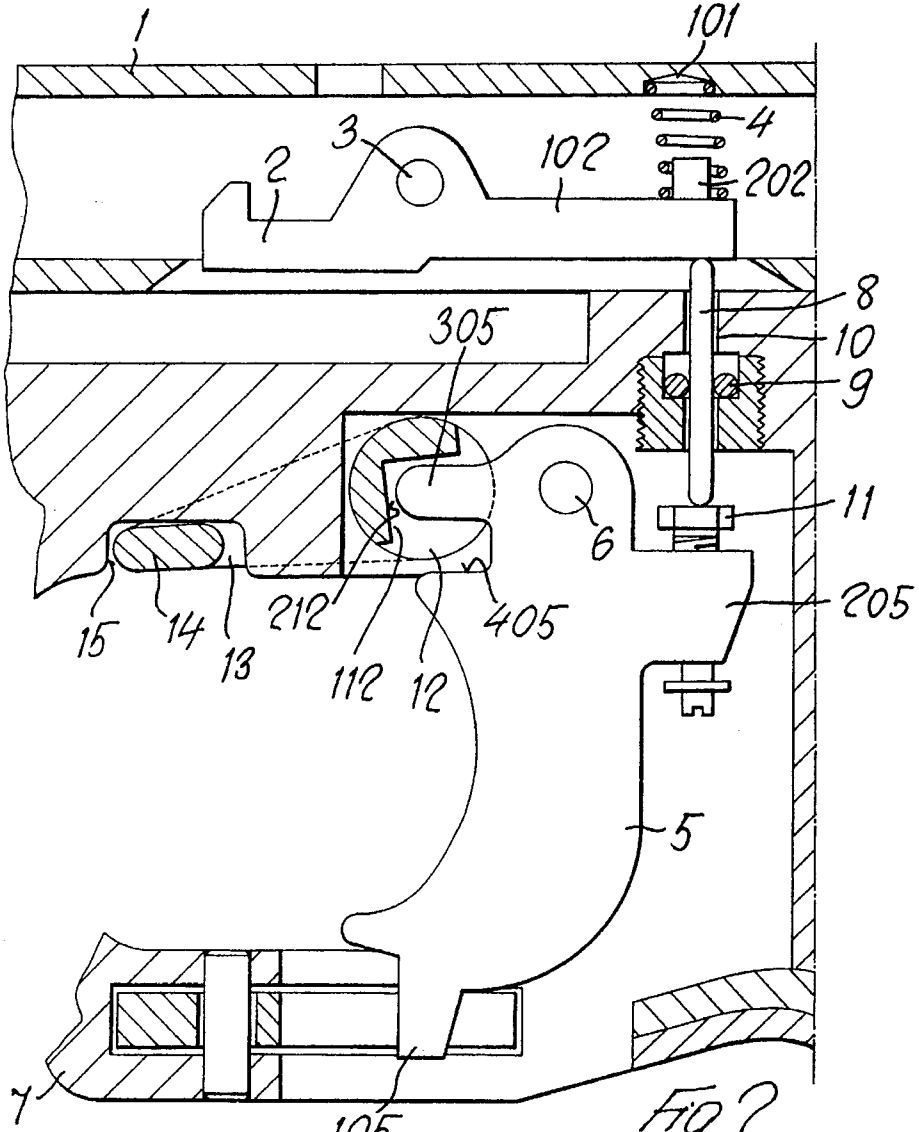
FIG. 2 is a view similar to FIG. 1, with the safety mechanism in the deactivated position.

Substantially at the same level as the hinged end of the trigger 5, in front of the latter, in the body of the gun is mounted a safety element in the form of a pin 12 which is transverse to the plane of oscillation of the trigger 5 and rotates around its own axis. In its median area, which coincides with the trigger 5, the pin 12 has an element for locking the trigger 5 against its oscillation, in the direction of release of the hook 2 from the spear. The locking element consists of an L-shaped recess 112 which engages with a radial tooth 305 on the opposite front side of the trigger 5. The tooth 305 is oriented substantially radially relative to the fulcrum pin 6. The L-shaped recess 112 is made so that at least one of the two delimiting walls 212, which are at an angle to each other, is eccentric, or extends along a plane parallel to the axis of the safety catch pin 12, and intersects the latter. In an angular position (FIG. 1) of the safety catch pin 12, the wall 212 engages beneath the tooth 305, preventing the trigger 5 from oscillating backwards, in the direction of release of the hook 2 from the spear. Rotation of the safety catch element 12 through 90° clockwise and towards the front end of the gun releases the wall 212 from the tooth 305, such that the wall is taken into a substantially vertical position, so that the trigger 5 can be moved backwards, releasing the hook 2 from the spear (FIG. 2).

It will be appreciated that the recess 112 need not necessarily have L-shaped delimiting walls, as in the example illustrated. Only the wall 212 is strictly necessary. However the embodiment illustrated avoids excessive weakening of the safety catch pin 12.

Advantageously, the tooth 305 of the trigger 5 is formed by means of a recess 405 of a suitable width made in the trigger 5, and inside which the wall 212 is brought by rotating the safety catch pin 12 into the active safety position.

The transverse safety catch pin 12 passes through the body of the gun from one side to the other, and to its head ends there are attached two radial arms 13 which are parallel to one another, and the ends of which support an indication cross-piece 14. The radial arms 13 are disposed and are of a length such that in the active position of the safety catch element (FIG. 1), they are oriented substantially vertically downwards, whereas the indication cross-piece 14 abuts against the front edge of the trigger 5 in the area on which the finger is intended to be supported. In the inactive position of the safety catch element 12, the arms 13 are oriented towards the front end of the gun and the indication bar 14 is moved upwards, against the body of the gun, and preferably into a position completely inserted in a transverse accommodation recess 15.

By placing his finger on the trigger 5 when the safety catch pin 12 is in the active position, the user is certain to feel the presence of the transverse indication bar 14, so that he is constantly aware of the condition of activation of the safety catch. In addition, the structure according to this example enables the safety catch to be released very easily simply by moving the finger used to control the trigger, which can easily be used to push the transverse bar 14 forwards and upwards, by pressing on the rear side of the sections thereof which project laterally beyond the trigger 5, and thus bringing the safety catch pin 12 into the position of release from the tooth 305 of the trigger 5 (FIG. 2).

Figure 3:
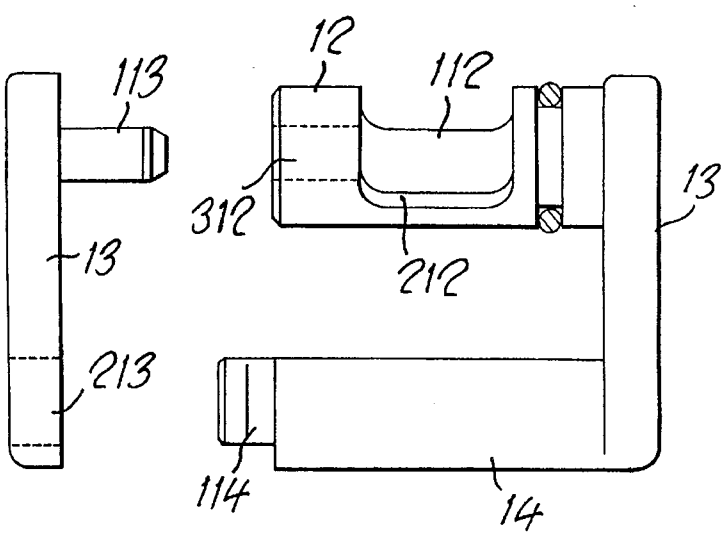
FIG. 3 is an exploded view in the axial direction of the gun, of the safety catch means according to the preceding figures.

With particular reference to FIG. 3, a safety catch element of the type described in this example can for example be made of plastics material and in two separate parts, which can be connected together at the time of fitting to the gun. One part comprises the safety catch pin 12 with the recess 112, an arm 13 and the transverse bar 14, and the other part consists only of the other arm 13 and has means of reciprocal insertion, both at the end which coincides with the free head side of the safety catch pin 12, and at the end which connects with the associated free end of the transverse bar 14. In particular, at the end associated with the safety catch pin, the two parts are coupled by means of an insertion pin 113 and a complementary axial hole 312 in the associated head side of the safety catch pin 12, whereas at the end associated with the transverse bar 14, the latter has an insertion projection 114 and the arm 13 has a complementary recess 213. The two parts can simply be inserted in one another, or can be glued, welded etc. This structural feature enables the safety catch to be fitted easily and quickly on the gun.

I claim:

1. A safety catch for an underwater gun having a body, a grip and a trigger mounted on said grip, said trigger including a finger engagement area whereby said trigger is rearwardly moveable by a user's finger for releasing a firing device of said gun, said safety catch comprising:

securing means for securing said trigger in a locked position in which movement of said trigger is prevented; and moving means for moving said securing means between said locked position and an unlocked position in which said trigger is moveable, said moving means being positioned to be contacted by a finger of a user in said finger engagement area when said securing means is in said locked position and being positioned so as not to be contacted by a finger of a user in the finger engagement area when said securing means is in said unlocked position to allow unobstructed access to said trigger, said moving means being moveable between said locked and unlocked positions by a finger of the user located near the finger engagement area, said moving means including a member positioned to be touched by a user when in the locked position as the user normally engages the trigger.

2. The safety catch according to claim 1 wherein said moving means comprises at least one extension piece having one end connected to said securing means and being positioned adjacent to said trigger in said locked position.

3. The safety catch according to claim 2 wherein said member is connected to said extension piece, a longitudinal axis of said member extending in a direction transverse to the trigger and to a plane of oscillation of the trigger.

4. The safety catch according to claim 3 wherein said member is connected to said extension piece at an end opposite the end connected to said securing means.

5. The safety catch according to claim 4 wherein said member comprises a bar extending across a width of the trigger, such that said bar is adjacent said finger engagement area when said trigger is in said locked position.

6. The safety catch according to claim 4 wherein said securing means comprises a pin positioned in said gun, a longitudinal axis of said pin extending in a direction transverse to the trigger and to a plane of oscillation of the trigger, said pin being rotatable about its longitudinal axis for engaging and releasing a tooth of said trigger.

7. The safety catch according to claim 6 wherein said pin, said member and said extension piece are constructed in one piece.

8. The safety catch according to claim 6 wherein said pin includes a recess having at least one wall oriented along a plane parallel to the longitudinal axis of said pin and intersecting eccentrically with the pin, said wall engaging the tooth of the trigger in said locking position.

9. The safety catch according to claim 8 wherein said recess comprises two perpendicular walls, whereby said recess has an L-shaped profile.

10. The safety catch according to claim 4 wherein said pin extends through a width of said gun and said means for moving comprises two extension pieces attached to respective ends of said pin, said member being connected to free ends of each of said two extension pieces.

11. The safety catch according to claim 4 wherein said member adheres to a lower side of the gun body in said unlocked position.

12. The safety catch according to claim 11 wherein the lower side of the gun body includes a complementary recess for receiving the member.

* * * * *

US005465517C1

(12) REEXAMINATION CERTIFICATE (4317th)

United States Patent

Garofalo

(10) Number: US 5,465,517 C1

(45) Certificate Issued: Apr. 24, 2001

(54) SAFETY CATCH FOR UNDERWATER GUNS

(75) Inventor: Giovanni Garofalo, Rapallo (IT)

(73) Assignee: HTM Sport S.p.A., Rapallo (IT)

Reexamination Request:
No. 90/005,678, Mar. 15, 2000

Reexamination Certificate for:

| | |
|---|---|
| Patent No.: | **5,465,517** |
| Issued: | **Nov. 14, 1995** |
| Appl. No.: | **08/297,546** |
| Filed: | **Aug. 31, 1994** |

(30) Foreign Application Priority Data

Sep. 29, 1993 (IT) ..... GE93A0084

(51) Int. Cl.[7] ..... F41A 17/46

(52) U.S. Cl. ..... 42/70.06; 42/1.14

(58) Field of Search ..... 42/70.06, 1.14; 124/22, 40

(56) References Cited

U.S. PATENT DOCUMENTS

| | | | |
|---|---|---|---|
| 846,591 | 3/1907 | Mason | 42/21 |
| 2,657,490 | 11/1953 | Browning | 42/70.06 |
| 3,222,809 | 12/1965 | Bryan | 42/70.06 |
| 4,962,747 | 10/1990 | Biller | 124/40 |
| 5,341,732 | 8/1994 | Landers | 42/70.06 |

FOREIGN PATENT DOCUMENTS 2557967 7/1985 (FR) .

*Primary Examiner*—Stephen M. Johnson

(57) ABSTRACT

A safety catch in particular for underwater guns or the like, comprises movable means for locking the travel of a trigger for activation of means of firing a projectile element. In oder to avoid direct, visual checking of the condition of the safety catch, according to the invention the safety catch is provided with means for indicating the condition of activation thereof, which in the position of locking the travel of the trigger are disposed such that they can be felt directly by the hand or finger which controls activation of the trigger, in the normal position For grapsing the grip of the gun and/or the trigger.

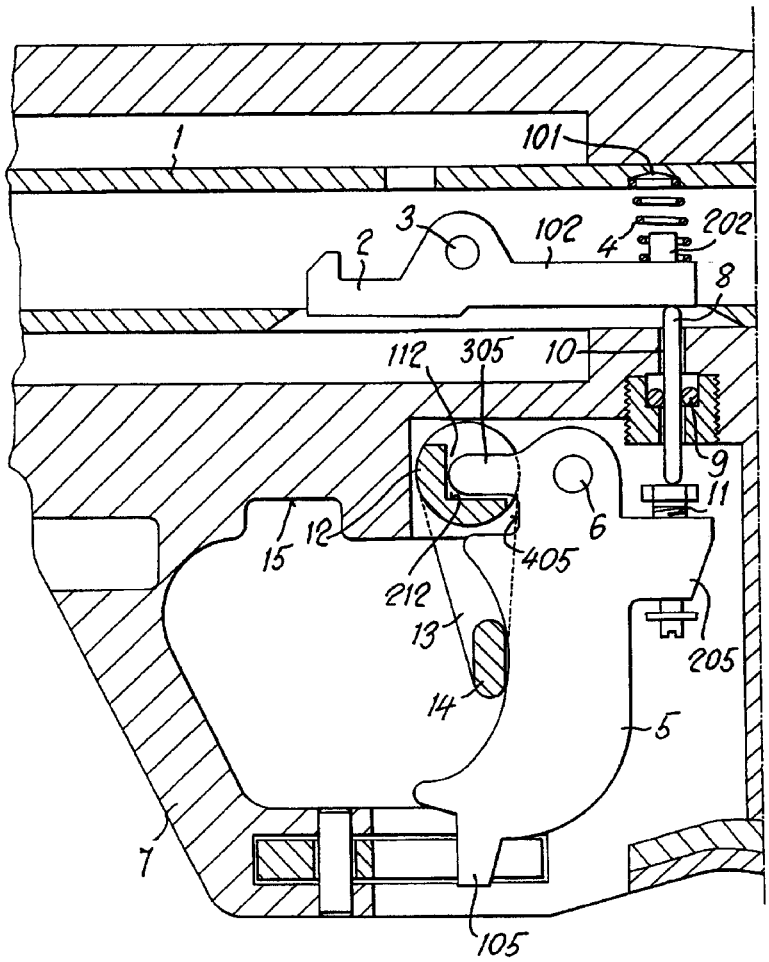

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–12 is confirmed.

* * * * *